US011769647B2

(12) United States Patent
Flachenecker et al.

(10) Patent No.: US 11,769,647 B2
(45) Date of Patent: Sep. 26, 2023

(54) FLUID COOLED REFLECTIVE X-RAY SOURCE

(71) Applicant: Carl Zeiss X-ray Microscopy, Inc., Dublin, CA (US)

(72) Inventors: Claus Flachenecker, Hayward, CA (US); Bruce Borchers, Scotts Valley, CA (US)

(73) Assignee: Carl Zeiss X-ray Microscopy, Inc., Dublin, CA (US)

( * ) Notice: Subject to any disclaimer, the term of this patent is extended or adjusted under 35 U.S.C. 154(b) by 0 days.

(21) Appl. No.: 17/453,036

(22) Filed: Nov. 1, 2021

(65) Prior Publication Data

US 2023/0135447 A1 May 4, 2023

(51) Int. Cl.

| | |
|---|---|
| ***H01J 35/14*** | (2006.01) |
| ***H01J 35/18*** | (2006.01) |
| ***H01J 35/12*** | (2006.01) |

(52) U.S. Cl.
CPC ..... *H01J 35/13* (2019.05); *H01J 35/153* (2019.05); *H01J 35/18* (2013.01)

(58) Field of Classification Search
CPC ..... H01J 35/13; H01J 35/153; H01J 35/18
See application file for complete search history.

(56) References Cited

U.S. PATENT DOCUMENTS

| | | | |
|---|---|---|---|
| 2,329,318 | A | 9/1943 | Atlee et al. |
| 2,356,645 | A | 8/1944 | Atlee et al. |
| 2,559,526 | A | 7/1951 | Van De et al. |
| 6,301,332 | B1 | 10/2001 | Rogers et al. |
| 2005/0100133 | A1 | 5/2005 | Reinhold |
| 2012/0099700 | A1 | 4/2012 | Rogers et al. |
| 2012/0326031 | A1 | 12/2012 | Wiedmann et al. |
| 2020/0154553 | A1 | 5/2020 | Dokania et al. |

FOREIGN PATENT DOCUMENTS

| | | | |
|---|---|---|---|
| CN | 1252618 | A | 5/2000 |
| DE | 102006032606 | A1 | 1/2008 |
| WO | WO 2008/006552 | A1 | 1/2008 |

OTHER PUBLICATIONS

European Search Report, completed on March 15, 2023, from European Application No. EP 22202571.0 13 pages.
European Search Report, completed Jul. 3, 2323, from European Application No. EP 22202571.0 20 pages.

*Primary Examiner* — Mark R Gaworecki
(74) *Attorney, Agent, or Firm* — HoustonHogle LLP

(57) ABSTRACT

During operation of a reflection target x-ray source, heat must be removed from many components. The electron beam must be steered to the target and may interact with structures along this path. There is also heat generated in the target itself. This can be excessive, since only a very small percentage of the electron beam's energy is transformed into x-rays. Finally, the x-rays must exit the vacuum through the window, which can also be heated both by the x-rays, reflected electrons, and radiant heat from the target. A water cooled reflective x-ray source provides for water or other fluid cooling of the centering aperture, x-ray target, and/or exit window.

21 Claims, 5 Drawing Sheets

FLUID COOLED REFLECTIVE X-RAY SOURCE

BACKGROUND OF THE INVENTION

X-rays are widely used in microscopy because of their short wavelengths and ability to penetrate objects. Typically, the best source of x-rays is a synchrotron, but these are expensive systems. So, often so-called tube or laboratory x-ray sources are used in which a generated electron beam bombards a target. The resulting x-rays include characteristic line(s) determined by the target's elemental composition and broad bremsstrahlung radiation.

There are a few basic configurations for x-ray microscopy systems. Some employ a condenser to concentrate the x-rays onto the object under study and/or an objective lens to image the x-rays after interaction with the object. The resolution and aberrations associated with these types of microscopes are usually determined by the spectral characteristics of the x-rays. Some microscopy systems employ a projection configuration in which a small x-ray source spot is used often in conjunction with geometric magnification to image the object.

Performance and particularly resolution are affected by different factors. Because the projection configuration does not have aberrations, the resolution is typically determined by the size of the x-ray source spot. Ideally, the x-ray source spot would be a point spot. In practice, the x-ray source spot is considerably larger. Generally, the source spot size is determined by the electron optics and the ability of those optics to focus the electron beam down to a point. Source spot sizes are generally around 5-200 micrometers (m) with good electron optics; although in other examples x-ray-source spot size may be 1-5 millimeters (mm) when power is a more important figure of merit. For transmission-target x-ray sources, spot sizes of a few micrometers are common, such as 1 μm to 5 μm. In any event, x-ray-source sizes will generally limit the resolution of an x-ray projection microscope.

For many microscopy applications, a reflection-target x-ray source is used. In the basic configuration of an x-ray tube, thermionic or field emission electrons are generated at a cathode (filament) in a vacuum tube and accelerated in a vacuum to an anode (forming an electron beam which is shaped by different electrostatic and (electro-) magnetic optical elements. For example, magnetic lenses often use coils of copper wire inside iron pole pieces. A current through the coils creates a magnetic field in the bore of the pole pieces. The electron beam then strikes the target at an oblique angle. The x-rays then typically pass through a window that is typically highly transmissive to the x-rays but can support the vacuum. Common target materials are for instance tungsten, copper, and chromium.

SUMMARY OF THE INVENTION

During operation of a reflection target x-ray source, heat must be removed from many components. The electron beam must be steered to the target and may interact with structures along this path. There is also heat generated in the target itself. This can be excessive, since only a very small percentage of the electron beam's energy is transformed into x-rays. Finally, the x-rays must exit the vacuum through the window, which can also be heated by the x-rays, reflected electrons, and radiant heat from the target.

In general, according to one aspect, the invention features an x-ray source. It comprises a target, an electron beam source for generating an electron beam for striking the target to generate x-rays, and a fluid cooled centering aperture between the electron beam source and the target.

In embodiments, the aperture tube has a decreasing inner diameter in the direction of the target and the aperture tube can extend between a focus yoke and a head body.

A sheath tube surrounding the aperture tube can be helpful. Then, fluid is circulated between the sheath tube and the aperture tube. Finally, a baffle is preferably located between the sheath tube and the aperture tube to direct the flow of fluid.

In general, according to another aspect, the invention features a method of operation of an x-ray source, comprising during an x-ray generation mode, using a flight tube beam steering system to steer an electron beam through an aperture tube to generate x-rays and deactivating the x-rays by controlling the flight tube beam steering system to steer the beam away from an aperture of the aperture tube.

In embodiments, the aperture tube can be fluid cooled. Also, a sheath tube can be used to surround the aperture tube, with a baffle between the sheath tube and the aperture tube to direct the fluid.

In embodiments, the window includes diamond. In addition, a head body can be included that has an x-ray port formed in the head to a distal side of the window.

A channel can be formed in the head body, which might extend around a periphery of the window. Further, an input channel and an output channel might be formed in the head body for flowing fluid through the channel.

In general, according to another aspect, the invention features a x-ray source, comprising a target, an electron beam source for generating an electron beam for striking the target, and a diamond window through which the x-rays exit.

In general, according to another aspect, the invention features an x-ray source, comprising a target, an electron beam source for generating an electron beam for striking the target, and a scattered electron detector for detecting electrons scattered from the target.

In general, according to another aspect, the invention features an x-ray source. It comprises an electrically isolated target, an electron beam source for generating an electron beam for striking the target to generate x-rays, and a fluid cooled aperture tube including a centering aperture between the electron beam source and the target, a diamond fluid cooled window through which the x-rays exit, and a scattered electron detector for detecting electrons scattered from the target, and a fluid cooling loop for flowing fluid across a backside of the target.

In general, according to another aspect, the invention features an x-ray source comprising an electrically isolated target, an electron beam source for generating an electron beam for striking the target to generate x-rays, and a fluid cooling loop for flowing fluid across a backside of the target.

In general, according to another aspect, the invention features an x-ray source comprising a target, an electron beam source for generating an electron beam for striking the target, and a fluid cooled window through which the x-rays exit.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
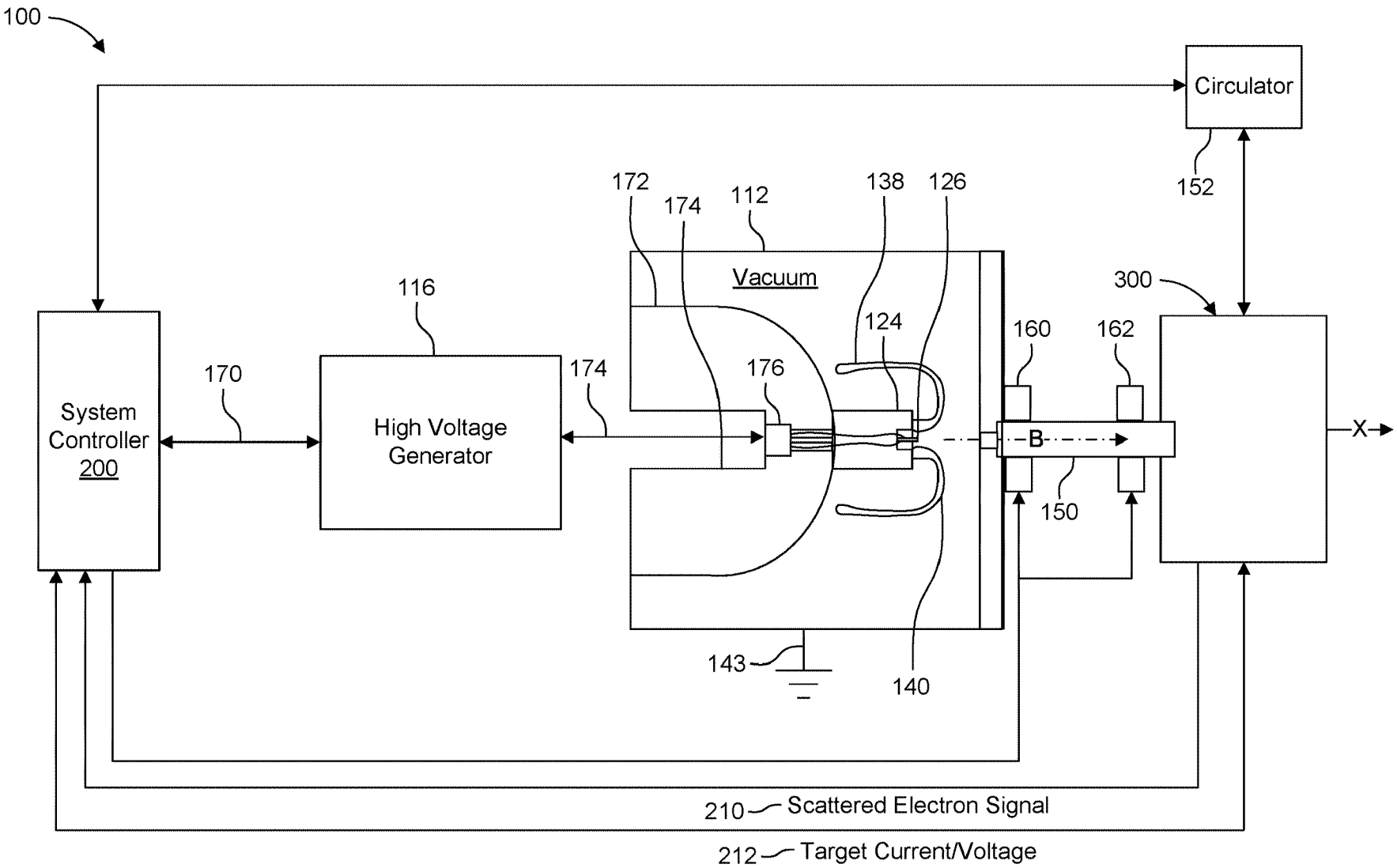
FIG. 1 is a schematic cross-sectional view of a reflective x-ray source.

FIG. 1 is a schematic cross-sectional view of an x-ray source 100.

The illustrated embodiment is a "reflection-target" source. The electron beam B strikes a target in the focus lens head assembly 300 at an oblique angle and the x-rays, which are emitted from the target, are used for illuminating an object. That said, many aspects of the following innovations are equally applicable to other x-ray tube source configurations including rotating anode and metal-jet anode.

In general, the x-ray source comprises a vacuum vessel 112. Preferably, the vacuum vessel 112 is metal, such as aluminum or stainless steel, for strength against the vacuum. Generally, the vacuum vessel 112 defines a volumetric evacuated region through which the electron beam B propagates from the electron emitter 126 (filament or cathode), to the target in the focus lens head assembly 300.

A system controller 200 is located outside the vacuum vessel 112. This contains the main controller and the data interfaces to external devices. It also contains the power supply for connection to a main electricity supply.

A high voltage generator 116 generates the power at the voltages required by the electron emitter 126. The high voltage generator 116 in a current example generates a negative acceleration voltage of 10's to 100's of kilovolts. The high voltages are provided via a power umbilical 170.

A vessel body 172 projects into the volumetric region defined by the vacuum vessel 112 from the proximal side of the vessel. It has an inner umbilical port 174 that extends through the vessel body 172 in the distal direction enabling the power umbilical to reach an umbilical plug assembly 176.

The electron emitter, e.g., filament, 126 is held in a filament mount 124, which is supported at the distal end of vessel body 172. In a current example, the electron emitter 126 includes a tungsten hairpin. It projects into the vacuum of the vacuum vessel to function as a thermionic source or electron emitter (cathode). Other configurations are possible, such as Lanthanum Hexaboride (LaB6) crystal and a carbon heater rod, CeB6, HfC and carbon-nanotube filaments.

A protective field cap 138 has a general bell shape, extending over the electron emitter 126 and its filament mount 124 and wrapping back to the distal end of the vessel body 172. Its distal end functions a suppression or grid anode 140. It aids in regulating the shape and intensity of the emitted electrons that form beam B.

The beam B is directed into a flight tube 150 mounted to a distal wall of the vacuum vessel 112.

Along the flight tube 150 are arranged a flight tube beam steering and shaping system to condition the electron beam and guide the beam to a center of a subsequent focus lens and head assembly 300. Preferably, the flight tube beam steering and shaping system is comprised of a first octopole steering system 160 and a second octopole steering system 162. Each of these octopole systems comprises eight electromagnet coils that generate magnetic fields under the control of the system controller 200 to guide and shape the electron beam B.

The electron beam is then received by the focus lens and head assembly 300. This has the reflection target that the electron beam strikes to create the x-ray beam X.

Figure 2:
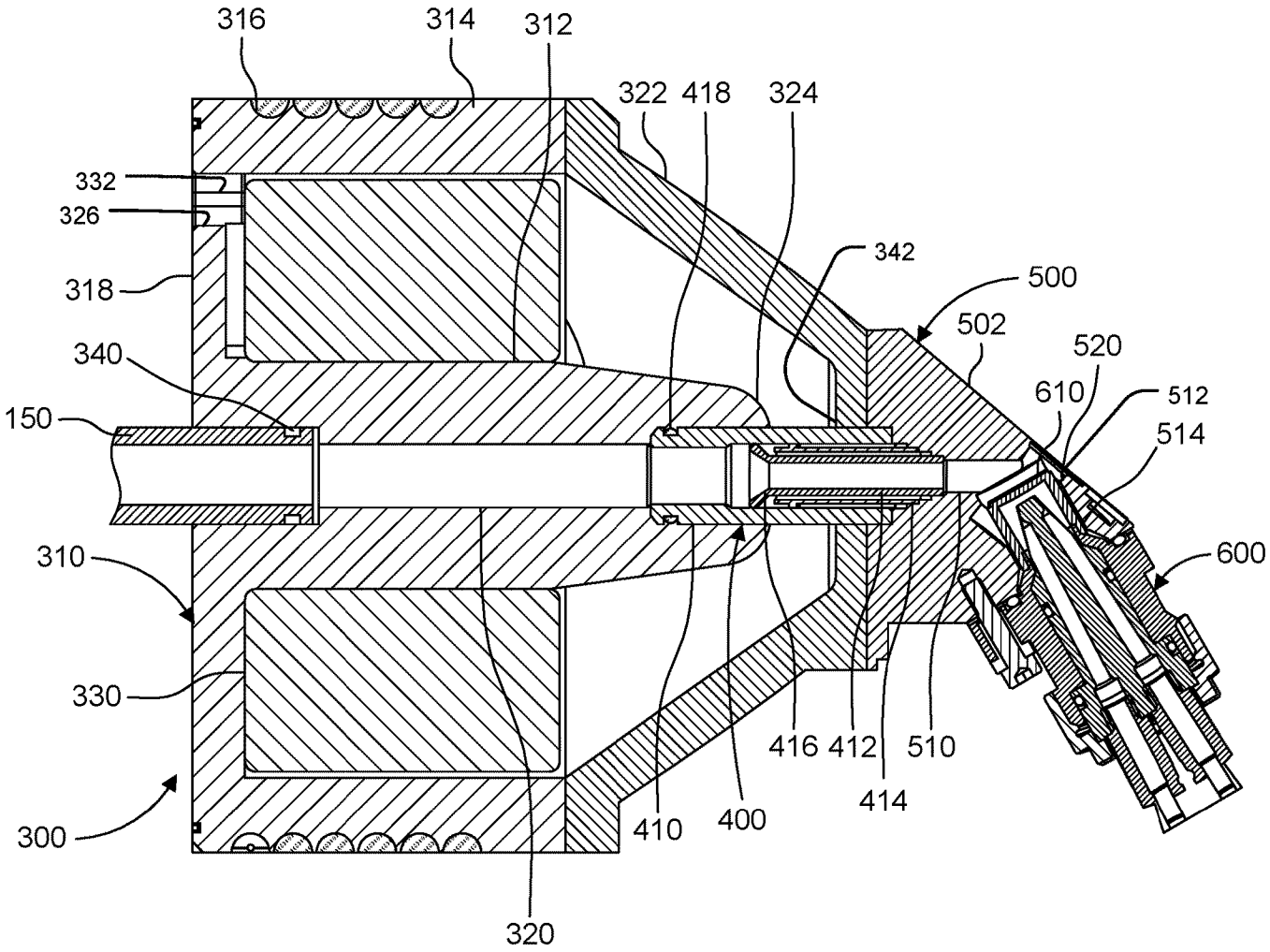
FIG. 2 is a cross sectional view of the focus lens head assembly 300 according to the present invention.

FIG. 2 is a cross sectional view of the reflection target assembly 300.

The flight tube 150 extends into a focus yoke 310. The flight tube 150 is coaxial with a yoke beam port 320 formed through a yoke center body 312. A flight tube/yoke o-ring 340 is located between the outer periphery of the flight tube and the inner wall of the yoke beam port 320 in order to provide a vacuum seal.

The yoke center body 312 is surrounded by a focus coil 330. Electrical current is provided to the focus coil 330 by a set of coil leads 332 from the system controller 200. These leads pass through a yoke wire port 326 formed in an annular shaped yoke rear body 318. The yoke rear body 318 extends from the proximal end of the yoke center body 312 outward to a yoke peripheral body 314. This yoke peripheral body is hollow cylinder-shaped, extending around the outer perimeter of the focus coil 330 and includes ports 316 through which cooling water is flowed.

A yoke cap 322 has a generally hollow frusto conical shape. Its proximal end engages with the distal end of the yoke peripheral body 314. Moving distally, converges back to the center axis and terminates with a distal pole tip 342. On the other hand, the yoke center body projects distally and terminates in a proximal pole tip 324.

A centering aperture assembly 400 is coaxial with the flight tube 150 and the yoke beam port 320. It extends between the distal end of the yoke center body 312 and specifically pole tip 324 and an inner aperture through the center of the yoke cap 322.

The centering aperture 416 extends through the center of the yoke cap 322 and seals against a head body 502 of a tube head 500. This extends the vacuum into the tube head so that the electron beam is coupled into a head beam port 510.

A target cartridge 600 holds a target 610 in the head beam port 510. The electron beam passing through the head beam port 510 can then strike this target 610 at an oblique angle. The generated x-rays pass into a head x-ray port 512 and then exit the volume through a x-ray port window 520.

Figure 3:
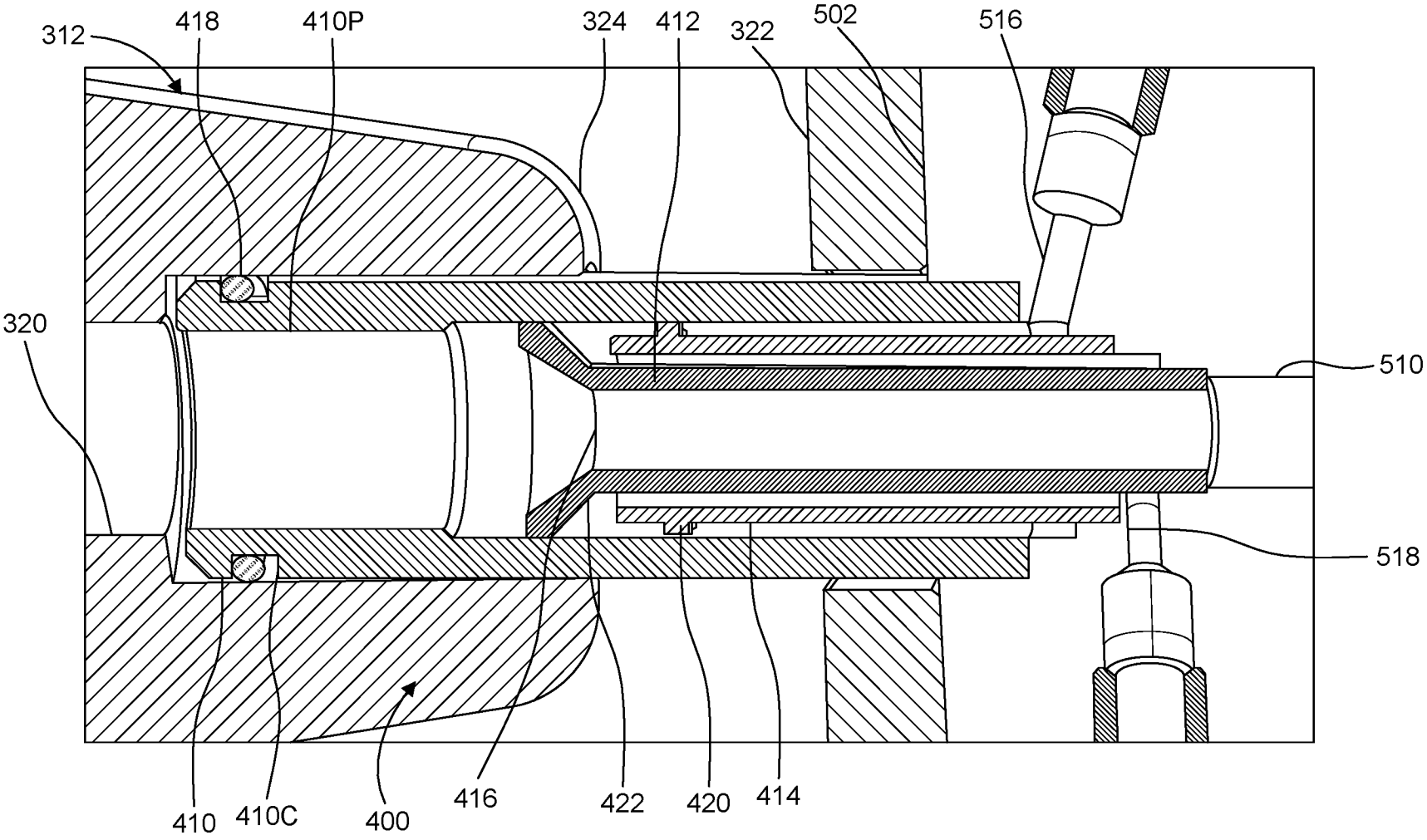
FIG. 3 is a cross sectional view showing the water cooled centering aperture assembly 400 according to the present invention.

FIG. 3 is a cross sectional view showing the water-cooled centering aperture assembly 400.

As a general rule, the centering aperture can be thermally stressed. The electron beam B can contain high levels of power and the centering aperture can absorb some or all of that power depending on the operation mode of the source. In addition, heat generated in the centering aperture can also affect other components such as the focus lens system 300. Thermal cycling can affect its operation. High temperatures can damage the vacuum-sealing O-rings and the focus coil 330.

The current embodiment provides for water cooling of the centering aperture assembly 400. In fact, the centering aperture is directly water cooled.

In more detail, sheath tube 410 extends into the distal end of the yoke beam port 320 of the yoke center body 312. A yoke/sheath o-ring 418 is used between the inner wall of an enlarged end of the yoke beam port 320 and the outer face of the sheath tube 410 in order to maintain the vacuum of the flight tube system. In fact, the yoke/sheath o-ring 418 is retained in an annular cut-out 410C formed in the outer face of the sheath tube 410. An internal surface defines a sheath tube beam port 410P. An aperture tube 412 is located inside and concentric with the sheath tube 410. The proximal end 422 of the aperture tube 412 is preferably brazed to the inner wall of the sheath tube and is in communication with the yoke beam port 320. The distal end of the aperture tube 412 is in communication with the head beam port 510 formed in the head body 502 and specifically seals with this port 510. A baffle 414 is located concentrically between the sheath tube and the aperture tube 412 and also seals at its distal end against the head body 502.

The proximal end 422 of the aperture tube 412 has a frusto conical shape to seal against the inner wall of the sheath tube 410. This proximal end narrows moving distally to form the centering aperture 416. Thus, the aperture tube 412 has a decreasing inner diameter in the direction of the target.

The baffle 414 creates a flow channel between the outer wall of the aperture tube 412 and the inner wall of the sheath tube 410. Specifically, a head aperture input water port 516 is formed in the head body 502 and connects to the channel between the inner wall of the sheath tube 410 and the outer wall of the distal end of the baffle 414. In a similar vein, a head aperture output water port 518 is formed in the head body 502 and is in communication with the region between the outer wall of the aperture tube 412 and the inner wall of the distal end of the baffle 414. In this way, water is then pumped to circulate along the length of the sheath tube 410 and the aperture tube 412 to remove generated heat.

The centering aperture can also be reduced in diameter and thus be transformed into a beam aperture, which can then be used to reject an outer part of the electron beam B, thus allowing for the generation of a smaller focal spot on the target.

In general, heat removal is important for protecting O-rings. Also the centering aperture can be used as a beam dump if it is desired to turn off the x-rays quickly. This is often done while adjusting the beam power and focus to keep the target safe from burn-in and carefully control the x-ray dose applied to the sample. In particular, the controller 200 controls the first octopole steering system 160 and second octopole steering system 162 of the flight tube beam steering and shaping system to steer the electron beam concentrically through the aperture tube 412 when generating x-rays. Then, to deactivate the x-rays, the controller controls the first octopole steering system 160 and second octopole steering system 162 to steer the beam away from the centering aperture so that the beam instead preferably strikes and grounds into the proximal end 422 of the aperture tube 412, which is directly water cooled.

Figure 4:
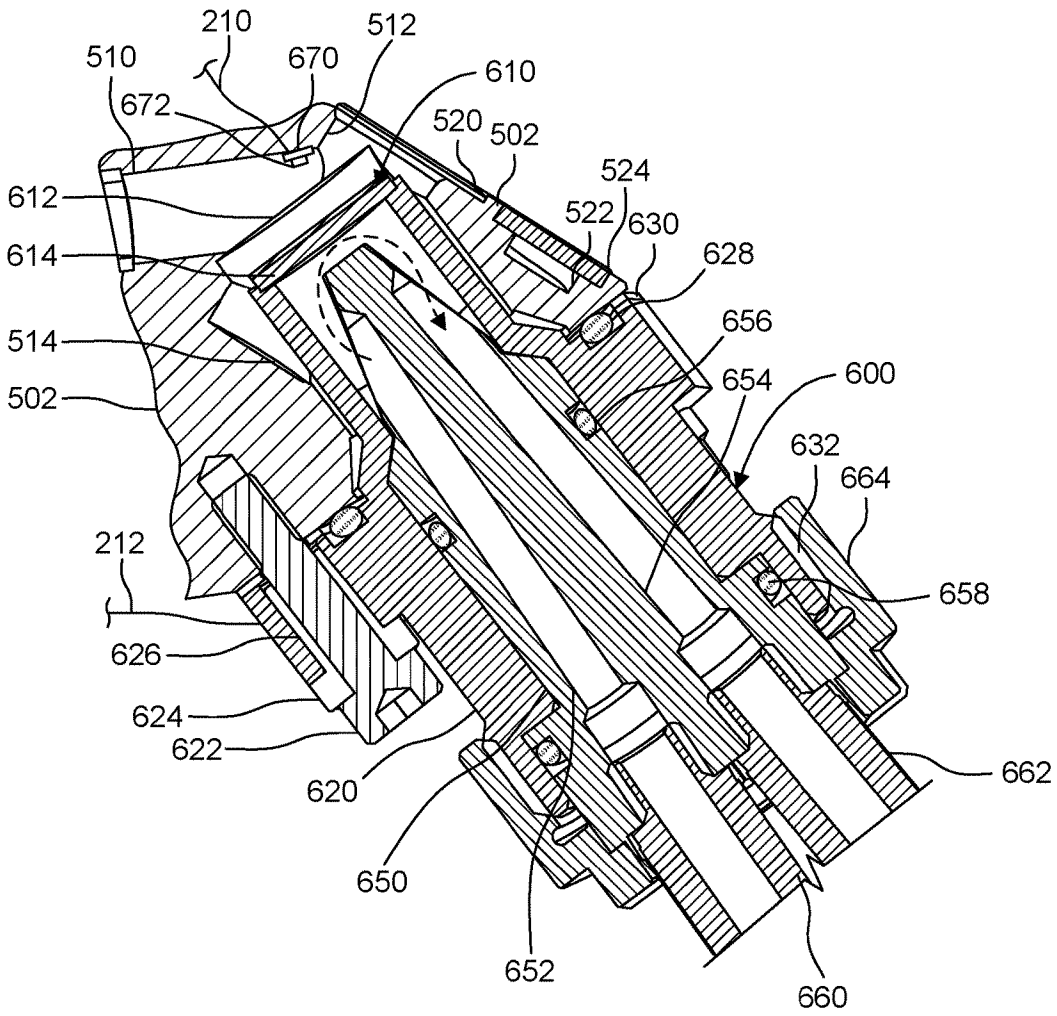
FIG. 4 is a cross sectional view of the water cooled target cartridge mounted in the head body according to the present invention.

FIG. 4 is a cross sectional view of the water cooled target cartridge 600.

During operation, the electron beam strikes the target 610 and generates x-rays by interaction with its target metal layer 612. These x-rays are emitted through the head x-ray port 512 and through an x-ray port window 520 to thereby leave the vacuum of the source.

As a general rule, the target 610 should also be cooled. Most of the energy of the electron beam B is deposited in the target 610 as heat since the process of x-ray generation is rather inefficient. In the worst case, the electron beam can actually burn a hole through the target. This is addressed in the current embodiment by the direct cooling of the target.

In more detail, the target 610 is mounted at the end of a tubular end portion of a cartridge frame 620. The target metal layer 612 faces into the head beam port 510. The metal layer 612 is formed on a target substrate 614 that is preferably brazed to the end of the cartridge frame 620. Preferably, the target substrate 614 is diamond to maximize thermal conductivity and minimize the risk of melting. Also, diamond can be exposed to large electron flux without compromising the vacuum seal. So even if the tungsten melts, the seal between the vacuum and the cooling water will not be compromised.

In a current embodiment, the target metal layer 612 is electrically connected to the cartridge frame. Then the controller 200 monitors the target current and controls the voltage of the target via the target current/voltage control line 212.

The cartridge frame 620 is inserted into a head cartridge port 514 that is formed in the head body 502. A cartridge/head o-ring 628 is located between a shoulder of the cartridge frame 620 and the head body 502. This seals the vacuum of the head beam port 510.

The cartridge frame 620 is mounted to and held in the head body by an arrangement of machine bolts 622. The bolts are inserted into bolt holes 626 of the cartridge frame 620 and are screwed into tapped holes formed in the head body 502. This pulls the shoulder of the cartridge frame 620 against the head body and the target into the head beam port 510. This compresses the cartridge/head o-ring 628 to seal the vacuum.

In the preferred embodiment, the target metal layer 612 is electrically connected to the cartridge frame in the brazing process and the cartridge frame 620 is electrically isolated from the head body 502. This allows for the detection of the electrical current generated by the electron beam striking the target 610 and control of the target voltage by the controller via the target current/voltage control line 212.

This electrical isolation is provided a number of ways. A cartridge isolation ring 620 ensures a standoff between the shoulder of the cartridge frame 620 and the head body 502. In addition, the machine bolts 622 are electrically isolated from the cartridge frame 620 by plastic insulating sleeves 624.

A port insert 650 is inserted into the cartridge frame 620. An insert input water port 652 and an insert output water port 654 are formed through the port insert 650. This provides a water circulation channel that extends through the length of the cartridge frame 620 so that water can be circulated in contact with the backside of the target 610. Water is provided to these ports via respective target supply tube 660 and a target return tube 662.

Two o-rings, an insert/cartridge forward o-ring 656 and insert/cartridge rear o-ring 658 are located between the outer periphery of the port insert 650 and the inner wall of the cartridge frame 620. These provide a fluid tight seal to ensure that water does not leak out of the cooling loop for the target 610.

The port insert 650 is secured into the cartridge frame 620 by an insert thrust ring 664. Specifically, the thrust ring engages with the remote end of the port insert 650 and screws onto thrust ring threads 632 formed on the remote end of the cartridge frame 620. This thrust ring 664 is tightened down on to the cartridge frame 620 to seat the port insert 650 into the inner side of the cartridge frame 620. Also note that this configuration allows the loosening of the thrust ring and the rotation of the target so that the beam will strike a fresh region of the target, though the target will eventually experience burn in. On the other hand, when fully tightened, the thrust ring mechanically stabilizes the target in the head.

Also note that in alternative embodiments, the water is replaced with oil as the cooling fluid. Oil provides better electrical isolation allowing better control of the target voltage and target current monitoring. In addition, the voltage control is also used to check if there is proper isolation between the target and ground. By applying a voltage and then reading the leakage current is used to measure the leakage resistance of the target to ground.

In one embodiment, a scattered electron detector 672 is further provided in the head beam port 510 or possibly the head x-ray port 512. This allows the controller 200 to monitor the magnitude of electrons that are scattered from the target 610 via the scattered electron monitoring line 210. This signal is used by the system controller 200 to determine the amount of target burn-in caused by the electron beam.

Figure 5:
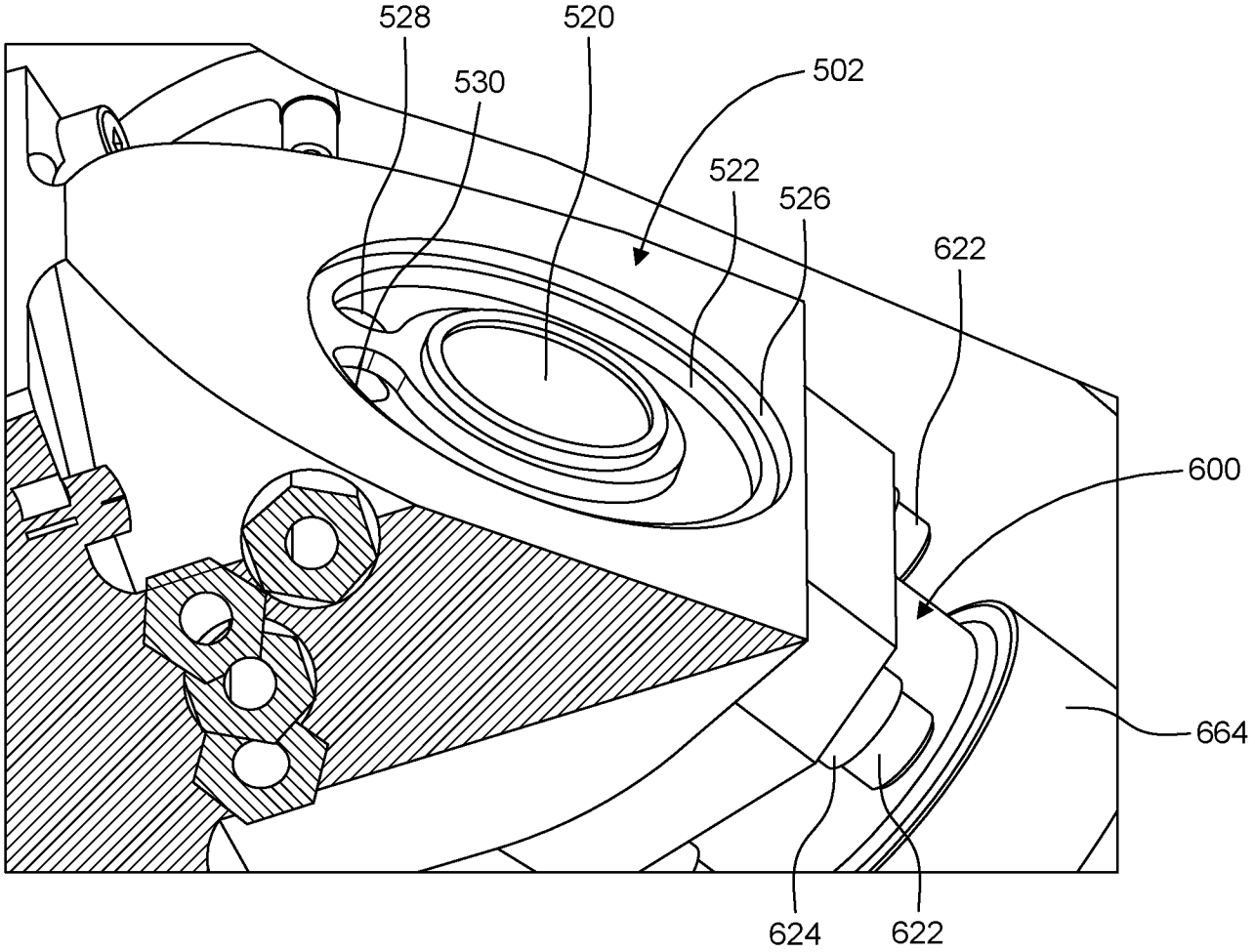
FIG. 5 is a perspective view showing the head body and the water cooling for the x-ray port window according to the present invention.

FIG. 5 is a perspective view showing the head body and the water cooling for the x-ray port window 520.

As a general rule, the x-ray port window should also be cooled. The window is necessary to maintain the vacuum in the source. Yet the cover is exposed to heating a number of ways. Electrons can reflect off of the target 610 and then deposit their energy in the x-ray port window 520. In addition, the x-rays themselves can be absorbed in the window. On the other hand, the cover should be maintained at the coolest temperature possible. Often, in microscope projection arrangements, the x-ray port window should be located as close to the sample as possible to maximize geometric magnification. This proximity, however, can damage some samples when the port window becomes excessively hot, simply by black body radiation.

In the current environment, a port water channel 522 is provided coaxially around the x-ray port window. In the current environment, this port channel 522 is fabricated in the head body 502. Water is fed into the port channel 522 by a port input channel 528 and water is removed from the channel by a port output channel 530. The water in the channel is sealed by a channel cover 524 (see FIG. 4) that seals the port water channel 522. In this way, during operation, heat generated in the diamond x-ray port window 520 is efficiently removed to the head body 502 and then water circulated in the port water channel 522 removes that heat. This keeps the temperature of the x-ray port window 520 low. At the same time, the diamond material will exhibit minimal damage from scattered electrons.

While this invention has been particularly shown and described with references to preferred embodiments thereof, it will be understood by those skilled in the art that various changes in form and details may be made therein without departing from the scope of the invention encompassed by the appended claims.

What is claimed is:

1. An x-ray source, comprising:

a target;

an electron beam source for generating an electron beam for striking the target to generate x-rays;

a fluid cooled aperture tube including a centering aperture between the electron beam source and the target; and a sheath tube surrounding the aperture tube.

2. The source as claimed in claim 1, wherein the aperture tube has a decreasing inner diameter in the direction of the target.

3. The source as claimed in claim 1, wherein the aperture tube extends between a focus yoke and a head body.

4. The source as claimed in claim 1, wherein fluid is circulated between the sheath tube and the aperture tube.

5. The source as claimed in claim 1, further comprising a baffle between the sheath tube and the aperture tube to direct the flow of fluid.

6. A method of operation of an x-ray source, comprising:

during an x-ray generation mode, using a flight tube beam steering system to steer an electron beam through an aperture tube to generate x-rays; and deactivating the x-rays by controlling the flight tube beam steering system to steer the beam away from an aperture of the aperture tube, which is fluid cooled and has a surrounding sheath tube.

7. The method as claimed in claim 6, further comprising directly fluid cooling the aperture tube.

8. The method as claimed in claim 7, wherein the aperture tube has a decreasing inner diameter in the direction of the target.

9. The method as claimed in claim 6, further comprising circulating the fluid between the sheath tube and the aperture tube.

10. The method as claimed in claim 9, further comprising employing a baffle between the sheath tube and the aperture tube to direct the fluid.

11. An x-ray source, comprising:

a target;

an electron beam source for generating an electron beam for striking the target;

a fluid cooled window through which the x-rays exit; and a fluid cooled aperture tube including a centering aperture between the electron beam source and the target, with a surrounding sheath tube.

12. The source as claimed in claim 11, wherein the window includes diamond.

13. The source as claimed in claim 11, further comprising a head body including an x-ray port formed in the head body to a distal side of the window.

14. The source as claimed in claim 11, further comprising a channel formed in the head body.

15. The source as claimed in claim 14, wherein the channel extends around a periphery of the window.

16. The source as claimed in claim 14, further comprising an input channel and an output channel formed in the head body for flowing fluid through the channel.

17. The source as claimed in claim 11, wherein the fluid is water.

18. An x-ray source, comprising:

a target;

an electron beam source for generating an electron beam for striking the target;

a diamond window through which the x-rays exit; and a fluid cooled aperture tube including a centering aperture between the electron beam source and the target, with a surrounding sheath tube.

19. An x-ray source, comprising:

a target;

an electron beam source for generating an electron beam for striking the target;

a scattered electron detector for detecting electrons scattered from the target; and a fluid cooled aperture tube including a centering aperture between the electron beam source and the target, with a surrounding sheath tube.

20. An x-ray source, comprising:

an electrically isolated target;

an electron beam source for generating an electron beam for striking the target to generate x-rays;

a fluid cooling loop for flowing fluid across a backside of the target and a fluid cooled aperture tube including a centering aperture between the electron beam source and the target, with a surrounding sheath tube.

21. An x-ray source, comprising:

an electrically isolated target;

an electron beam source for generating an electron beam for striking the target to generate x-rays;

a fluid cooled aperture tube including a centering aperture between the electron beam source and the target, with a surrounding sheath tube;

a diamond fluid cooled window through which the x-rays exit;

a scattered electron detector for detecting electrons scattered from the target; and a fluid cooling loop for flowing fluid across a backside of the target.

* * * * *